US005135457A

United States Patent [19]

Caruso

[11] Patent Number: 5,135,457

[45] Date of Patent: Aug. 4, 1992

[54] CALF EXERCISE MACHINE

[76] Inventor: John F. Caruso, 7550 Hinson St., Unit 5B, Orlando, Fla. 32819

[21] Appl. No.: 560,091

[22] Filed: Jul. 27, 1990

[51] Int. Cl.[5] ..... A63B 21/00

[52] U.S. Cl. ..... 482/137; 482/79; 482/100; 482/134

[58] Field of Search ..... 272/117, 118, 96, 94, 272/130, 134

[56] References Cited

U.S. PATENT DOCUMENTS

| | | | |
|---|---|---|---|
| 2,467,943 | 4/1949 | Mikell | 272/96 |
| 2,472,391 | 6/1949 | Albizu . | |
| 2,542,074 | 11/1949 | Bierman . | |
| 3,598,404 | 8/1971 | Bowman | 272/96 X |
| 4,084,815 | 4/1978 | Flannery | 272/119 |
| 4,169,589 | 10/1979 | McArthur | 272/118 |
| 4,203,593 | 5/1980 | Coppelman | 272/117 |
| 4,290,598 | 9/1981 | Flannery | 272/117 |
| 4,346,887 | 8/1982 | Poole | 272/117 |
| 4,452,447 | 6/1984 | Leplet et al. | 272/96 |
| 4,511,137 | 4/1985 | Jones | 272/118 |
| 4,550,908 | 11/1985 | Dixon | 272/96 X |
| 4,591,149 | 5/1986 | Godfrey | 272/118 |
| 4,600,188 | 7/1986 | Bangerter et al. | 272/96 |
| 4,650,183 | 3/1987 | McIntyre | 272/96 |
| 4,727,860 | 3/1988 | McIntyre | 272/96 X |
| 4,733,859 | 3/1988 | Kock et al. | 272/96 |
| 4,807,874 | 2/1989 | Little | 272/96 |

*Primary Examiner*—Robert Bahr

[57] ABSTRACT

A calf exercise machine to develop the muscles with a plantarflexion movement and dorsiflexion movement. The main muscles involved in these two movements while the subject is using the machine are the soleus and the tibialis anterior. The soleus muscle is isolated in this machine by bending the knee to place that muscle in a bio-mechanically advantageous position. During plantarflexion movement, the angle between the tibia and femur muscle is kept to a minimum. The bottom of the subject's foot pushes against a leverage arm to contract the soleus muscle. During dorsiflexion, the subject's foot moves the leverage arm back to the starting position of the exercise.

11 Claims, 2 Drawing Sheets

CALF EXERCISE MACHINE

BACKGROUND OF THE INVENTION

This apparatus relates to a calf exercise machine that can be used both in a health club/gymnasium setting as well as in an orthopedic rehabilitation setting. More particularly, this machine relates to isolating the soleus muscle in a better way than is done with conventional weight training equipment found in gymnasiums (specifically, the seated calf machine).

Various calf exercise machines have heretofore been designed, (but most maintain the tibia at an angle greater than 90 degrees from the femur during the exercise movement. These machines typically provide a resistance when the bottom of the foot pushes against a foot pedal located on the machine. Further, many of the machines exercise the calf muscle while the leg is fully extended. Further, these machines do not constrain the knee throughout the exercise movement. Consequently the soleus muscle is not placed in the most bio-mechanically advantageous position during the exercise.

Examples of exercisers are disclosed in U.S. Pat. Nos. 2,472,391, 2,542,074, 4,169,589, 4,346,887, 4,511,137, 4,591,149 and 4,807,874.

SUMMARY OF THE INVENTION

An object of this invention is to provide an improved calf exercise machine.

Another object of this invention is to provide an exercise machine that exercises the soleus muscle in a bio-mechanically advantageous position.

It is also an object of this invention to allow dorsiflexion and plantarflexion movement while providing a resistance during each movement.

An additional object of this invention is to restrain the knee during the exercise to isolate muscles in the calf during the exercise.

These and other objects are provided by reducing the angle between the tibia and femur (normally 180 degrees when a person is standing) to concomitantly increase the soleus muscle involvement during a plantarflexion movement and a dorsiflexion movement. The use of an angled knee brace allows an angle of far less than 90 degrees between the tibia and femur to isolate the soleus muscle. The machine includes an angled knee brace to tilt the tibia toward the femur to place the soleus muscle in a bio-mechanically advantageous position.

Plantarflexion movement is accomplished by maintaining the angle between the tibia and the femur at less than 90 degrees. The ball of the foot is pushed against a leverage arm to contract the soleus muscle.

Dorsiflexion movement is accomplished by reversing the plantarflexion motion by the subject pulling his toes towards his shins (tibia bones). The muscle primarily involved in this movement is the tibialis anterior, the muscle which borders each tibia laterally from knee to ankle.

Resistance may be provided with the use of a tension bar against the direction of movement of the foot in both the plantarflexion movement and the dorsiflexion movement. Thus, an increased resistance to the calf muscle is accomplished through the exercise.

This machine may further be used as an orthopedic rehabilitation device. The primary muscles in a plantarflexion/dorsiflexion movement with the knee bent are the soleus and the tibialis anterior, respectively. Other muscles (peroneus longus, peroneus brevis, tibialis posterior, flexor digitorum longus, extensor digitorum longus, etc.) combine to give a synergistic effect to contract against resistance in either direction. These other muscles also are involved in walking. Proper care and rehabilitation of these other muscles can hasten the recovery process of those persons who are unable to work or who may require physical therapy for the knee and ankle areas.

DESCRIPTION OF THE PREFERRED EMBODIMENTS

Figure 2A:
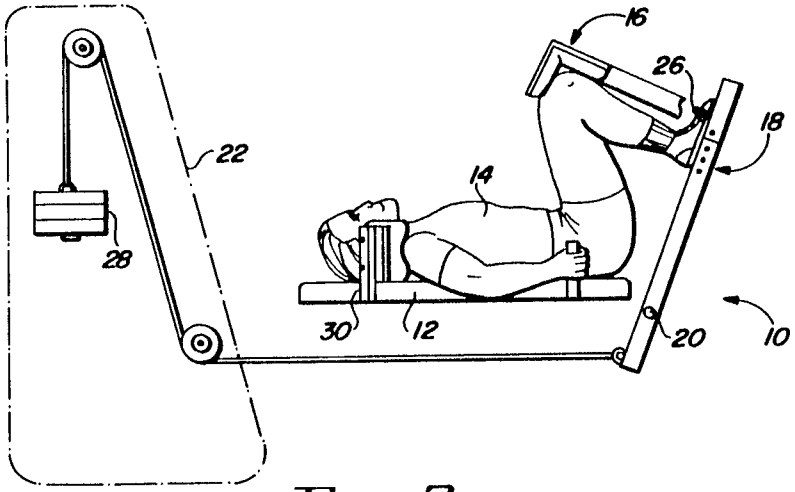
FIG. 2*a* shows a diagrammatic view of the principles of operation of the exercise machine shown in FIG. 3 during dorsiflexion movement with the subject in the proper position having knees braced while the subject's foot pulls the leverage arm.
Figure 2B:
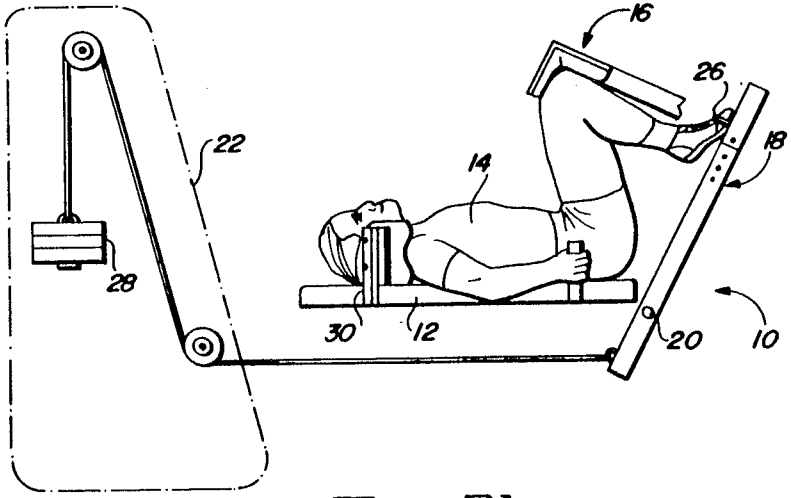
FIG. 2*b* shows the diagrammatic view as shown in FIG. 2*a* with the dorsiflexion movement near completion.
Figure 3:
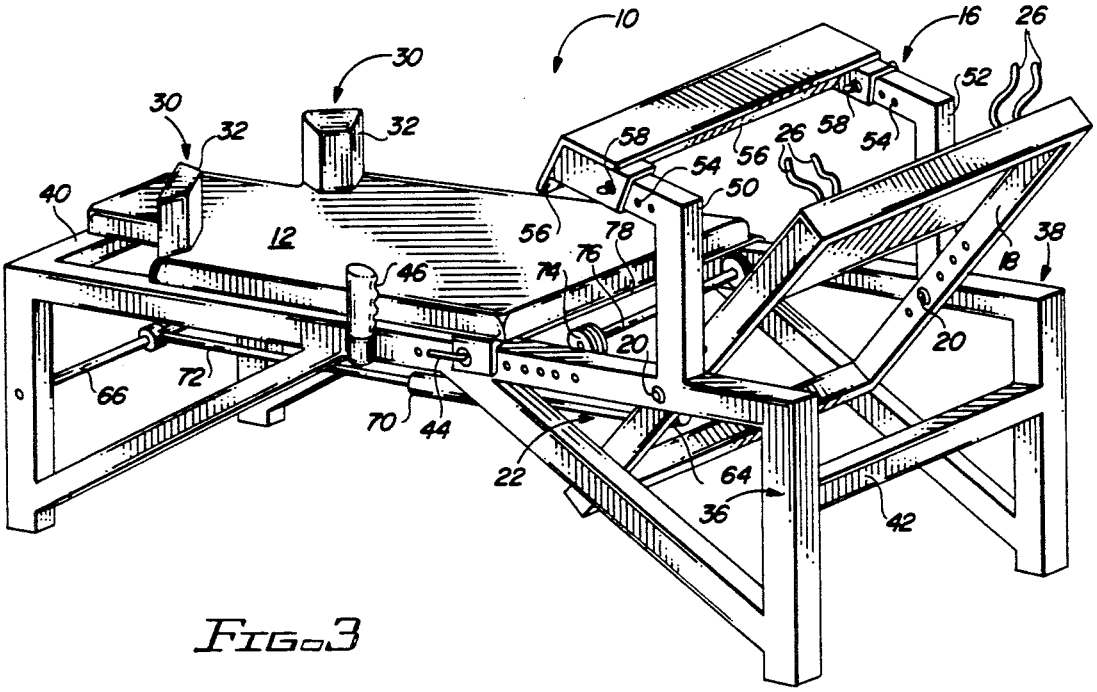
FIG. 3 shows a perspective view of the exercise machine.

Referring to FIGS. 1 (*a–b*) and FIGS. 2 (*a–b*), there is shown an illustration of the principles of operation for a subject using exercise machine 10 displayed in FIG. 3. FIGS. 1 (*a–b*) show subject 14 using exercise machine 10 displayed in FIG. 3 in the plantarflexion direction of movement, and FIGS. 2 (*a–b*) show subject 14 using the calf exercise machine 10 displayed in FIG. 3 in the dorsiflexion direction of movement.

Figure 1A:
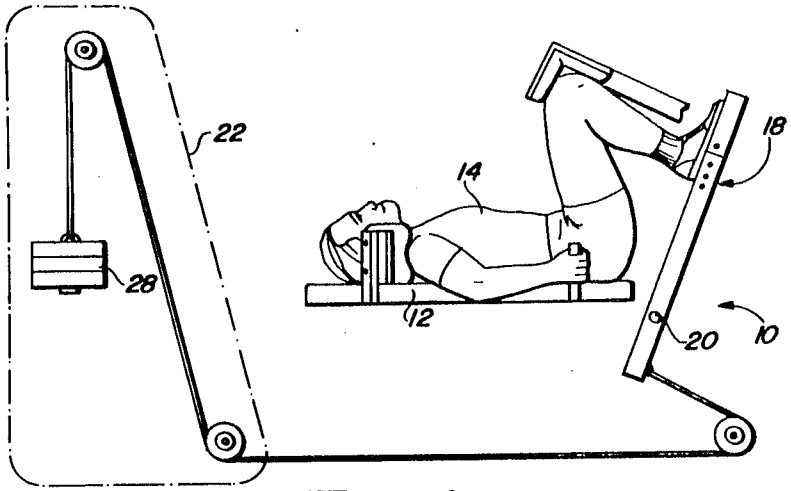
FIG. 1*a* shows a diagrammatic view of the principles of operation of the exercise machine shown in FIG. 3 during plantarflexion movement with the subject properly positioned, having knees braced while the subject's foot pushes against a leverage arm.
Figure 1B:
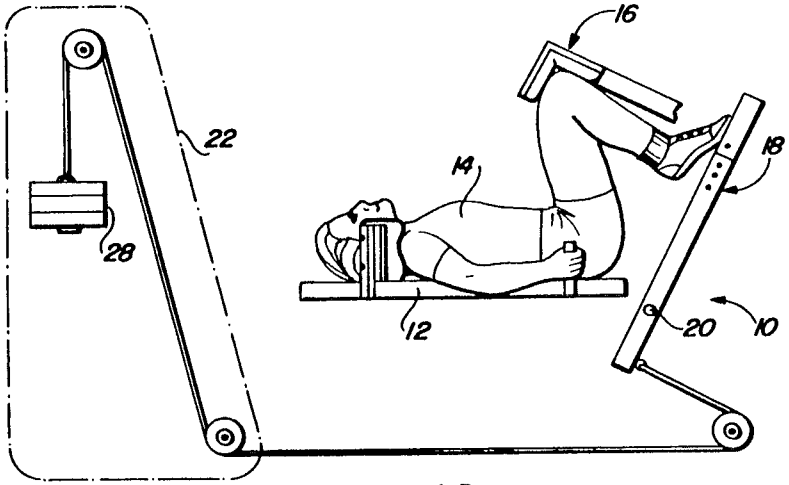
FIG. 1*b* shows the diagrammatic view as shown in FIG. 1*a* with the plantarflexion movement near completion.

Referring to FIGS. 1–3, the exercise machine 10 includes a sliding table 12, mounted in a horizontal position, for supporting subject 14. Disposed above subject 14 is knee brace 16 for constraining the knee of subject 14 when subject 14 uses exercise machine 10. The foot of subject 14 rests against leverage arm 18 which rotates around pivot 20. During plantarflexion movements (illustrated in FIGS. 1*a–b*) the foot pushes against leverage arm 18 to allow it to rotate clockwise about pivot 20. During dorsiflexion movement (illustrated in FIGS. 2*a–b*) the foot pulls leverage arm 18 to allow it to rotate counterclockwise about pivot 20. Although this disclosure is described using one foot, exercise machine 10 may be easily modified to accommodate either foot or both feet.

A tension adjustment device 22 is coupled to leverage arm 18 through pulley 24 on the distal side of pivot 20 from the foot of subject 14. Tension adjustment device 22 has weights 28 that apply a force to leverage arm 18 in the opposite direction of the foot's direction of movement when the foot rotates about the ankle.

Referring to FIGS. 2 (*a–b*), coupled to the foot of subject 14 is foot strap 26. Strap 26 holds leverage arm 18 to the foot of subject 14 during the dorsiflexion movement. Further, tension adjustment device 22 provides a resistance to the movement of leverage arm 18, when leverage arm 18 is rotated counterclockwise by the foot of subject 14 during dorsiflexion movement.

Referring to FIGS. 1 (*a–b*) and FIGS. 2 (*a–b*), sliding table 12 is horizontally adjustable with respect to leverage arm 18 for ease of entering and exiting exercise machine 10. Sliding table 12 has shoulder supports 30 to constrain subject.

In the plantarflexion movement, subject 14 is first positioned in exercise machine 10, as shown in FIG. 1*a*, with the knee of subject 14 constrained by knee brace 16, and the front half of the foot of subject 14 resting against leverage arm 18. The toes or ball of the foot of subject 14 are then pushed forward causing the foot of subject 14 to rotate about the ankle and leverage arm 18 to rotate about pivot 20. Tension adjustment device 22 provides resistance to the movement of leverage arm 18 by exerting a force on the distal side of pivot 20 with respect to the foot.

Referring to FIG. 1*b*, as the foot continues to rotate about its ankle and push leverage arm 18, leverage arm 18 rotates about pivot 20 in the clockwise direction. Leverage arm 18 then extends away from pulley as the soleus muscle contracts. It is recognized that by constraining the knee with knee brace 16 during the plantarflexion movements, the soleus muscle is exercised in a bio-mechanically advantageous position.

Referring to FIG. 2*a*, in the dorsiflexion movement the subject is seated in exercise machine 10, as previously described, and then pulls his toes toward his shins. This causes leverage arm 18 to rotate counterclockwise about pivot 20. As leverage arm 18 rotates counterclockwise, tension adjustment device 22 exerts a resistance against leverage arm 18 opposite to the direction of its movement about pivot 20.

Referring to FIG. 2*b*, as the toes of subject 14 are pulled toward the shin of subject 14, resistance is exerted opposing the rotation of movement of leverage arm 18.

Referring to FIG. 3, there is shown, completely assembled, exercise machine 10. To use exercise machine 10 a subject (not shown) lies lengthwise along sliding table 12, resting his shoulders against shoulder pads 32 coupled to shoulder supports 30. Sliding table 12 rests on horizontal framework 34 having a left-side frame 36 and a right-side frame 38. Left-side and right-side frames 36 and 38 are attached to each other with horizontal support frame 40, disposed near where the head of the subject would be positioned on sliding table 12, and another horizontal support frame 42, closer to the foot of subject on sliding table 12. It is noted that horizontal support frame 42 is lower on framework 34 than support frame 40; this is so as to allow clearance for a full range of motion for leverage arm 18.

Figure 4:
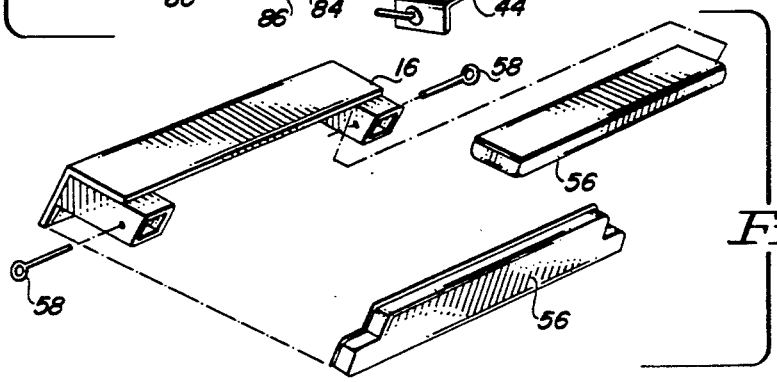
FIG. 4 shows a perspective view of the assembly of adjustable knee brace with knee pads and adjustment pins.

Coupled to left-side frame 36 and right-side frame 38 are knee brace bars 50 and 52, respectively. Knee brace bars 50 and 52 support knee brace 16. Knee brace bars 50 and 52 place a proper bend at the knee joints of subject to maximally engage the soleus muscle. Adjustment holes 54 on knee brace bars 50 and 52 allow for knee brace 16 to properly fit subject firmly. Referring to FIGS. 3 and 4, knee brace pad 56 lines the inside of knee brace 16 to provide comfort for the knee during the exercise period. Referring to FIG. 3, adjustment holes 54 on knee brace 16 are secured to knee brace bars 50 and 52 with adjustment pins 58.

Rectangular shaped leverage arm 18 is coupled to horizontal framework 34 with pivot 20. A foot plate 60 is welded to leverage arm 18. During operation the subject's foot rests at the bottom of foot plate 60 and is secured by strap 26. Located within leverage arm 18 are adjustment holes 62 that allow the position of leverage arm 18 to be finely adjusted so that plantarflexion movements and dorsiflexion movements go through as full and smooth a range of motion as possible.

Locking mechanism 44 locks sliding table 12 in place on framework 34 so that the subject may easily get on and off sliding table 12. This locking mechanism 44 is preferably spring-loaded to easily disengage locking mechanism 44. Sliding table 12 slides parallel to left-side frame 36 and right-side frame 38. When the subject rests on sliding table 12, the subject may disengage locking mechanism 44 and then pull himself towards knee brace 16 by grabbing onto handlebars 46 which are attached to framework 34. Once the sliding table 12 is moved to the desired position, that position may be maintained by engaging locking mechanism 44 on each side of the exercise machine 10.

A tension rod receptacle 64 is welded to the bottom of leverage arm 18. Tension rod receptacle 64 acts as an anchoring point for tension adjustment device 22. Tension adjustment device 22 includes anchoring rod 66, pneumatic cylinder 70 and tension rod 72. Anchoring rod 66 extends between the left-side frame 36 and the right-side frame 38 and holds tension rod 72. Pneumatic cylinder 70 is coupled between anchoring rod 66 and tension rod receptacle 64 to provide resistance in both plantar/dorsiflexion movements. The tension of pneumatic cylinder 70 is adjusted by a knob (not shown) on pneumatic cylinder 70. Tension rod 72 does not slide when leverage arm 18 is pivoted as tension rod 72 is held in place with anchoring rod 66.

Figure 5:
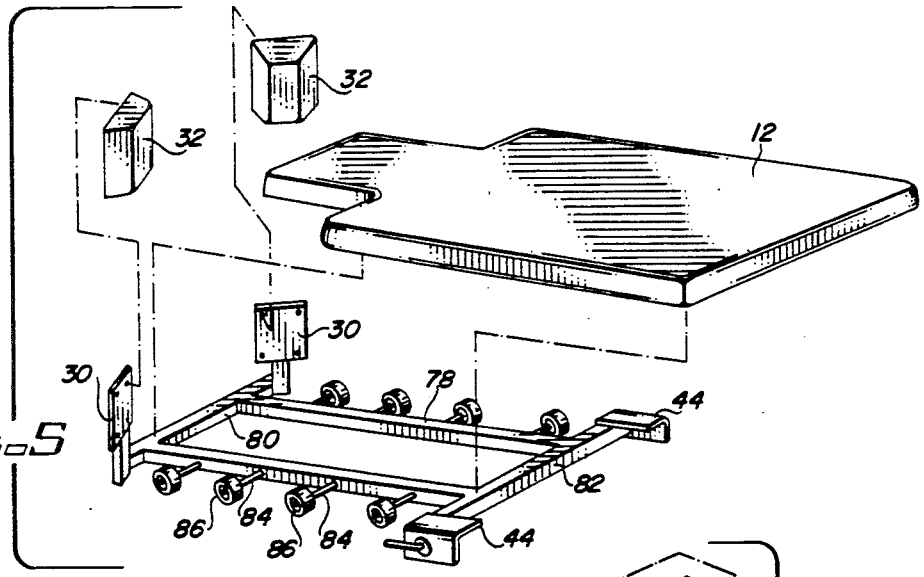
FIG. 5 shows a sliding table, frame and shoulder pads for the patient to lie upon, with the frame and sliding table having wheels which allow the patient to slide himself into the proper position.

Referring to FIG. 5, there is shown an exploded view of sliding table 12 that includes a padded cover 73 and a torso support frame 78 having shoulder supports 30 with shoulder pads 32.

Referring to FIG. 3, as previously mentioned, sliding table 12 moves parallel to left-side frame 36 and right-side frame 38. This is accomplished with axle wheels 74 which are attached to a pair of rotating axles 76 that is coupled to support framework 34. Each rotating axle 76 includes two wheels having a groove that allows torso support frame 78 to rest and run upon axle wheels 74.

Referring to FIG. 5, at the head of torso support frame 78 is neck support frame 80 and coupled to the other end of the torso support frame 78, is hip support frame 82, at both ends of hip support frame 82 is locking mechanism 44. Torso support frame 78 has axles 84 extending out from torso support frame 78. At the ends of axles 84 are frame wheels 86 which run inside a guide 88 (refer to FIG. 3) within horizontal framework 34.

Referring to FIG. 3, in operation the subject (not shown) moves sliding table 12 as far away from leverage arm 18 and then secures sliding table 12 in place with locking mechanism 44. Next subject adjusts the tension of pneumatic cylinder 70 by turning a tension knob (not shown) on pneumatic cylinder 70 in the appropriate direction. Next, the height of knee brace 16 should be adjusted by placing adjustment pins 58 in the proper adjustment holes 54. Leverage arm 18 is then positioned such that foot plate 60 is as close as possible to knee brace 16 to allow subject to easily slip on foot straps 26.

The subject may now lie on sliding table 12, resting his shoulders up against shoulder pads 32. Next, locking mechanism 44 is disengaged and by using handlebars 46, subject slides himself and sliding table 12 into the best possible position before locking sliding table 12 into place with locking mechanism 44. The subject then places the bottom of his foot up against foot plate 60 and secures his foot to foot plate 60 with foot strap 26. It is preferable that the foot arch and heel do not come in contact with foot plate 60. If necessary, subject may then use the strength of his thigh muscles to push leverage arm 18 away from knee brace 16 to accommodate the length of his tibia. Once enough distance has been made so that the tibia can smoothly fit into knee brace 16, the knees are brought up into knee brace 16 and are snugly fit against knee brace pads 56.

At this point subject may initiate the exercise, undergoing plantarflexion and dorsiflexion movements for the desired number of repetitions as explained in connection with FIGS. 1 (*a–b*) and FIGS. 2 (*a–b*). It is recognized that during these motions the angle between the shin and thigh of subject is less than 90 degrees. It is further recognized that maximum strengthening of the soleus occurs when the exercise is performed at an angle less than 90 degrees.

To disengage from calf exercise machine 10, subject drops his knees and pulls leverage arm 18 towards knee brace 16. Subject then frees his foot from foot strap 26 and disengages locking mechanism 44, thereby unlocking the position of sliding table 12. Subject may then push against handlebars 46 so that sliding table 12 travels back to the original starting position. Sliding table 12 may be then locked into place with locking mechanism 44 so that subject may safely get off the table until the next use.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method of exercising a calf muscle of a leg having a knee, an ankle, and a foot, the method comprising the steps of:

pushing the foot in a fist direction and in a plantarflexion movement about the axis of the ankle;

providing a retarding force having a second direction opposite to said first direction and opposing the plantarflexion movement;

pulling the foot in the second direction and in a dorsiflexion movement about the axis of the ankle;

providing a retarding force in the first direction opposing the dorsiflexion movement;

providing a brace that extends perpendicularly to the calf;

contacting the kneecap with the brace;

constraining with the brace the angle between the shin and the thigh less than 90 degrees during the dorsiflexion movement; and constraining the angle between the shin and the thigh substantially less than 90° during plantarflexion movement.

2. A calf exercise machine comprising:

means for supporting a subject;

means for resisting dorsiflexion movement of a foot when the foot pivots about the axis of the ankle to exercise the tibialis anterior muscle;

means coupled above said support means for constraining the knee of the supported subject in a position to maintain the angle between the shin and the thigh of the subject at an angle of less than 90° throughout the dorsiflexion movement of said foot;

means for resisting the movement of the foot pivoting in a plantarflexion movement about the axis of the angle; and means having an elongated brace extending substantially laterally across the supporting means for contacting the kneecap of the subject, and for constraining the knee in a position to maintain the angle between the shin and thigh of said subject at an angle less than 90° throughout plantarflexion movement of the foot.

3. A calf exercise machine comprising:

means for supporting a subject;

means including a brace extending laterally across said supporting means and adapted for contacting the knee-cap of the subject for constraining the angle between the shin and thigh of the supported subject at an angle less than 90°;

a leverage arm rotatably coupled to a pivot and operative to contact substantially all of the surface on the bottom of the foot of the subject;

tension means coupled to the arm for adjustably setting the amount of foot force required to rotate said leverage arm; and said leverage arm operative to attach to the foot and rotate about said pivot in response to plantarflexion movement of the foot about an axis through the ankle wherein when the foot rotates said leverage arm about said pivot, said leverage arm releases from the heel of the foot.

4. The machine as recited in claim 3 wherein said tension means sets the amount of force required to rotate said leverage arm during plantarflexion movement of the foot.

5. A calf exercise machine comprising:

a frame;

a table having a horizontal surface extending longitudinally on said frame and being adapted to hold an upper body of a subject in a substantially horizontal position;

a brace bar extending away from said frame in a direction above the level of said table;

a knee brace coupled to said brace bar, and extending laterally across said table;

a leverage arm pivotally coupled to said frame adjacent said brace bar;

a foot plate operative to hold the foot of the subject stationary extending laterally across said frame and operative to be pushed by a foot of the subject;

said brace and said plate being in a position with respect to said table such that when the subject lies on said table facing upward with the foot contacting said plate, a knee of the subject contacts said brace and an angle is maintained between a shin of the subject and the thigh of the subject less than 90° when the foot pivots said plate; and means for resisting said foot pivoting of said plate.

6. The calf exercise machine as recited in claim 5, wherein said resisting means is coupled to said leverage arm and extends longitudinally along said table.

7. The calf exercise machine as recited in claim 5, wherein said resisting means resists movement by the foot in a first direction, and resists movement by the foot in a second direction opposite to the first direction.

8. The calf exercise machine as recited in claim 5 further comprising a shoulder pad coupled to said table operative to restrain the upper body of the subject when the body of the subject faces upward, when the subject's knee contacts the brace and when the subject's foot pivots the foot plate.

9. The calf exercise machine as recited in claim 5 further comprising means for slidably coupling said table to said frame such that the position of the subject on said table can be adjusted by sliding the table in a longitudinal direction to change the angle between the knee and the shin.

10. The calf exercise machine as recited in claim 5 further comprising a knee brace pad extending laterally along the knee and adapted to contact the knee when said subject is on the table.

11. The calf exercise machine as recited in claim 5 wherein said foot plate moves away from the heel of the foot when said foot plate is pivoted by the foot of the subject.

* * * * *